US007963270B2

(12) United States Patent
Ricco et al.

(10) Patent No.: US 7,963,270 B2
(45) Date of Patent: Jun. 21, 2011

(54) FUEL INJECTOR WITH HIGH STABILITY OF OPERATION FOR AN INTERNAL-COMBUSTION ENGINE

(75) Inventors: Mario Ricco, Casamassima (IT); Sergio Stucchi, Valenzano (IT); Raffaele Ricco, Valenzano (IT); Onofrio De Michele, Valenzano (IT); Marcello Gargano, Valenzano (IT); Antonio Gravina, Valenzano (IT)

(73) Assignee: C.R.F. Società Consortile per Azioni, Orbassano (IT)

( * ) Notice: Subject to any disclaimer, the term of this patent is extended or adjusted under 35 U.S.C. 154(b) by 0 days.

(21) Appl. No.: 12/491,345

(22) Filed: Jun. 25, 2009

(65) Prior Publication Data

US 2009/0320801 A1 Dec. 31, 2009

(30) Foreign Application Priority Data

Jun. 27, 2008 (EP) ..... 08425458
Dec. 29, 2008 (EP) ..... 08173039

(51) Int. Cl.
*F02M 51/00* (2006.01)

(52) U.S. Cl. ..... 123/472; 123/490

(58) Field of Classification Search ..... 123/472, 123/478, 490; 251/129.01, 129.02, 129.15, 251/129.16; 239/585.3, 585.4, 585.5
See application file for complete search history.

(56) References Cited

U.S. PATENT DOCUMENTS 5,203,538 A 4/1993 Matsunaga et al.
5,820,101 A 10/1998 Ricco
6,109,541 A * 8/2000 Beatty et al. ..... 239/88
6,315,531 B1 * 11/2001 Schwarz ..... 417/505
7,013,876 B1 * 3/2006 Puckett et al. ..... 123/490
7,513,445 B2 * 4/2009 Ricco et al. ..... 239/585.3
2009/0320800 A1 12/2009 Ricco et al.
2010/0162992 A1 * 7/2010 Ricco et al. ..... 123/299
2010/0186708 A1 * 7/2010 Ricco et al. ..... 123/299

FOREIGN PATENT DOCUMENTS

DE 198 20 341 A1 5/1998
DE 10 2004 050 992 A1 4/2006
EP 0690958 1/1996
EP 0 851 116 A2 7/1998
EP 0851114 A 7/1998

(Continued)

OTHER PUBLICATIONS

European Search Report dated Nov. 2, 2009, as issued in application No. 08173039.2-1263.

(Continued)

*Primary Examiner* — Hai H Huynh

(74) *Attorney, Agent, or Firm* — Workman Nydegger

(57) ABSTRACT

The injector comprises a metering servo valve for controlling a rod for opening/closing a nebulizer. The servo valve has a valve body having a control chamber provided with an outlet passage that is opened/closed by an open/close element that is axially movable. The open/close element is separate from an armature of an electromagnet, and is slidable on an axial guide element for closing the outlet passage. The open/close element is held in the closing position by a spring acting through an intermediate body. The armature can be displaced with respect to the axial guide element between a flange of the intermediate body and a projection element of the guide member, for eliminating the rebounds of the open/close element upon closing of the solenoid valve.

21 Claims, 11 Drawing Sheets

FOREIGN PATENT DOCUMENTS

| | | | | |
|---|---|---|---|---|
| EP | 1045135 | A | | 10/2000 |
| EP | 1820958 | A | | 8/2007 |
| EP | 1 916 414 | A2 | | 4/2008 |
| EP | 1 918 568 | A1 | | 5/2008 |
| JP | 2010-7667 | | * | 1/2010 |

OTHER PUBLICATIONS

European PO; search report in foreign application (EP 08425458.0) to which priority is claimed; Nov. 28, 2008.

* cited by examiner

FUEL INJECTOR WITH HIGH STABILITY OF OPERATION FOR AN INTERNAL-COMBUSTION ENGINE

CROSS REFERENCE TO RELATED APPLICATION

This application is related to the following:

U.S. patent application Ser. No. 12/491,329 filed Jun. 25, 2009.

FIELD OF THE INVENTION

The present invention relates to a fuel injector with high stability of operation, for an internal-combustion engine, having a metering servo valve normally kept closed by an open/close element via elastic means.

BACKGROUND OF THE INVENTION

As is known, the metering servo valve comprises a chamber for controlling of the usual rod for governing injection. The control chamber has a hole for inlet of the pressurized fuel, and at least one discharge hole, which is opened/closed by the open/close element under the control of an armature of an electromagnet. The discharge hole is opened when the armature is actuated by the electromagnet, overcoming the action of elastic means acting on the open/close element.

In known injectors, during closing of the servo valve, the open/close element is subjected to a train of rebounds of decreasing amplitude, against a detent that defines the position of closing of the discharge hole. In general, the first rebound is of considerable amplitude and causes a re-opening of the control chamber, with consequent temporary decrease in pressure, thus increasing the duration of the injection and hence the amount of fuel injected. Also the subsequent rebounds can further increase the volume of fuel injected.

Upon closing of the servo valve, globally the rebounds of the open/close element hence cause an increase in the amount of fuel injected with respect to the amount envisaged by the usual electronic control unit for regulating injection. In addition, the train of rebounds, which occurs in the presence of vapour, rapidly deteriorates the surfaces corresponding to the area of sealing of the servo valve, thus shortening the life of the injector. Finally, the mode in which this train of rebounds occurs depends upon many factors, amongst which the life of the servo valve. In fact, in the servo valves of the injectors there are fluid-tight dynamic couplings, characterized by surfaces that slide in relative motion with fits in the region of a few microns. Consequently, machining errors entail a certain friction in the first few hours of operation; then, on account of the inevitable wear, these surfaces present less friction and hence the amplitude and length of the train of rebounds is even more accentuated.

It will be understood in any case how all this jeopardizes the robustness of operation of the injector. In fact, on account of the large number in factors affecting the rebounds, the excess of fuel introduced is unforeseeable so that is not possible to compensate for it automatically, for example, by introducing a corrective factor for the time of energization of the electromagnet. Consequently, especially when the engine is idling, the excess of fuel causes a variation in the air-to-fuel ratio, which departs from the optimal one, causing at exhaust an excess of pollutant emissions into the environment.

Known from the document U.S. Pat. No. 5,820,101 is a fuel injector in which the spherical open/close element is controlled by an axial stem guided by a fixed bushing and is pushed by a first spring into a closing position of the servo valve. The armature is guided by said stem and normally rests against a detent carried by the stem on account of the action of a second spring. When the electromagnet is de-energized, the first spring brings the stem into a closing position, drawing the armature along with it. Upon arrest of the open/close element in the closing position, the armature continues its travel by inertia against the action of the second spring, which then brings it back into contact with the detent of the stem. Consequently, the armature is not able to reduce the rebound of the open/close element.

There also has been proposed an injector with metering servo valve of a balanced type, in which the open/close element in the closing position is subjected to axial actions of pressure that are substantially zero so that it is possible to reduce both the pre-loading of the spring and the force of the electromagnet. The valve body of this servo valve comprises an axial stem designed to guide axially the armature of the electromagnet, which is provided with a duct for discharge of the control chamber, which gives out onto the side surface of the stem. The open/close element is formed by a bushing made of non-magnetic material, which engages in a fluid-tight way with the stem. The armature is fixed with respect to the bushing, from which it is separate, and is made of magnetic material in order to simplify production thereof.

Instead, since the bushing must form a seal with the side surface of the stem, and since the open/close element must close the discharge duct via engagement with an annular detent, requires an extremely precise machining, on a very hard high-quality material.

In this servo valve, even though the stroke of the open/close element is of just a few microns, the forces and accelerations involved always entail at least one rebound of the open/close element during closing. The rebound is favoured by the high levels of hardness of the parts, by the presence of vapour associated to the flow of fuel in the presence of high pressure gradients, and by the reduced surfaces, which come into contact along a ring of a width of 1-2 hundredths of millimeter so that in general there occurs a re-opening and a corresponding emptying-out of the control chamber.

In addition, in known injectors the wear of the open/close element and of the corresponding arrest in the closing position of the servo valve, renders operation of the servo valve deterioratable during the life of the injector, since the closing travel of the open/close element and hence the duration of opening of the control chamber varies. Consequently, all the settings made in the control unit for governing the injectors are unable to take into account the variations due to wear, which are totally unforeseeable.

SUMMARY OF THE INVENTION

The aim of the invention is to provide a fuel injector for an internal-combustion engine, in which operation of the servo valve will present a high stability, eliminating the drawbacks due to the rebounds of the open/close element and reducing the wear of the parts.

The above aim of the invention is provided by a fuel injector with balanced metering servo valve for an internal-combustion engine, as claimed in the attached claims.

BRIEF DESCRIPTION OF THE DRAWINGS

For a better understanding of the invention some preferred embodiments thereof are described herein, purely by way of non-limiting example, with the aid of the annexed drawings, wherein.

DETAILED DESCRIPTION OF THE INVENTION

Figure 1:
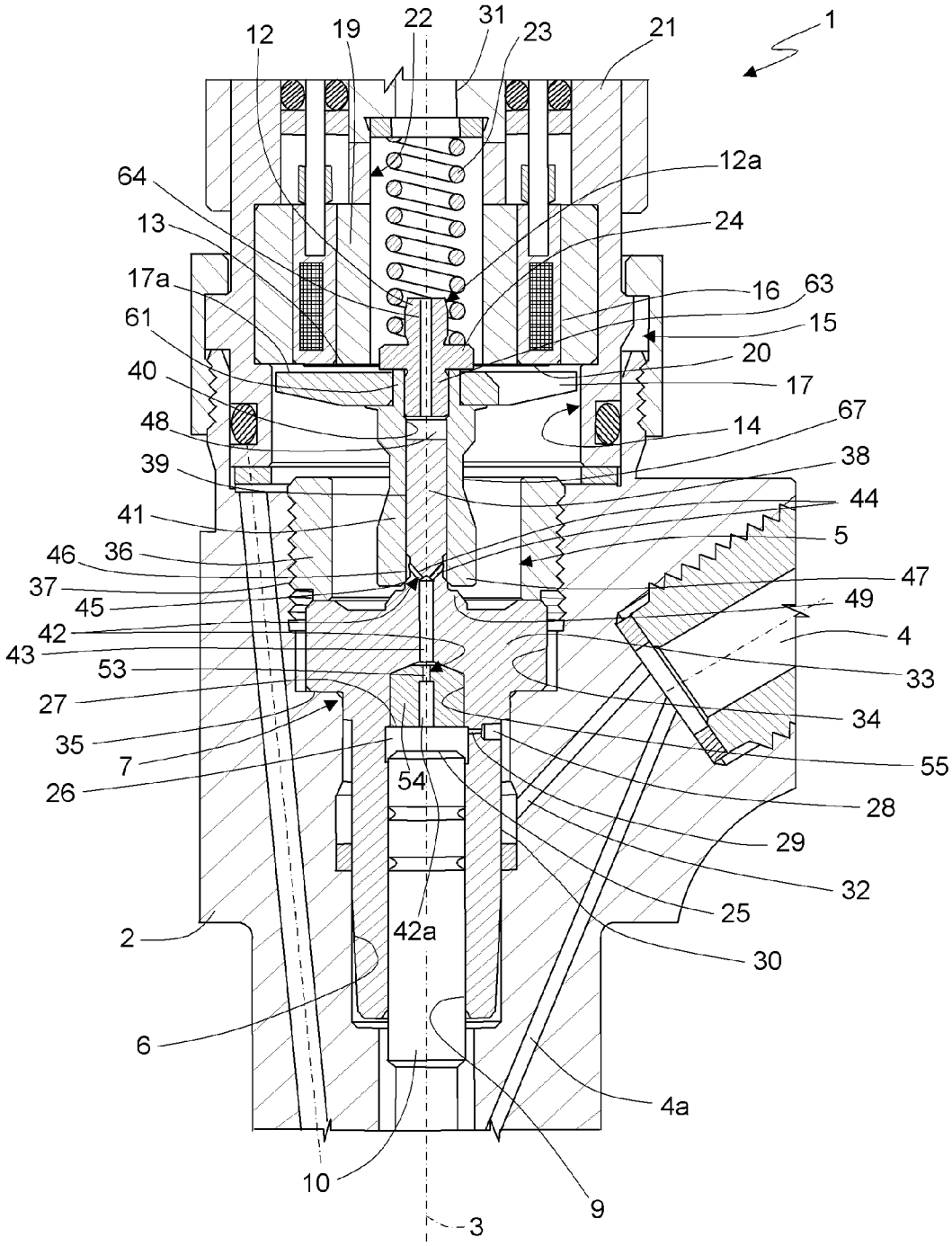
FIG. 1 is a partial vertical section of a high-stability fuel injector for an internal-combustion engine, according to a first embodiment of the invention.

With reference to FIG. 1, a fuel injector for an internal-combustion engine, in particular a diesel engine is designated as a whole by 1. The injector 1 comprises a hollow body or casing 2, which extends along a longitudinal axis 3, and has a side inlet 4 designed to be connected to a duct for intake of the fuel at high pressure, for example at a pressure in the region of 1800 bar. The casing 2 terminates with a nozzle, or nebulizer for injection of the fuel at the aforesaid high pressure (not visible in the figures), which is in communication with the inlet 4, through a duct 4*a*.

The casing 2 has an axial cavity 6, housed is in which a metering servo valve 5, which comprises a valve body 7 having an axial hole 9. A rod 10 is axially slidable in the hole 9, in a fluid-tight way for the fuel under pressure, for controlling injection. The casing 2 is provided with another cavity 14 sharing the same axis as the cavity 6 and housing an electric actuator 15, comprising an electromagnet 16 designed to control an armature 17 in the form of a notched disk. In particular, the electromagnet 16 comprises a magnetic core 19, which has a polar surface 20 perpendicular to the axis 3, and is held in position by a support 21.

The electric actuator 15 has an axial cavity 22 in communication with the discharge of the servo valve 5 to the usual fuel tank. Elastic means defined by a helical compression spring 23 are housed in the cavity 22. The spring 23 is preloaded so as to exert an action of thrust on the armature 17, in a direction opposite to the attraction exerted by the electromagnet 16 when this is energized. The spring 23 acts on the armature 17 through an intermediate body, designated as a whole by 12*a*, which comprises engagement means formed by a flange 24 made of a single piece with a pin 12 for guiding one end of the spring 23. A thin lamina 13 made of non-magnetic material is located between a top plane surface 17*a* of the armature 17 and the polar surface 20 of the core 19, in order to guarantee a certain gap between the armature 17 and the core 19.

The valve body 7 comprises a chamber 26 for controlling dosage of the fuel to be injected, which includes a space delimited radially by the side surface of the hole 9. Axially the volume of the control chamber 26 is delimited by an end surface 25 shaped like a truncated cone of the rod 10 and by an end wall 27 of the hole 9 itself. The control chamber 26 communicates permanently with the inlet 4, through a duct 32 made in the body 2 and an inlet duct 28 made in the valve body 7. The duct 28 is provided with a calibrated stretch 29, which gives out into the control chamber 26 in the vicinity of the end wall 27. On the outside of the valve body 7, the inlet duct 28 gives out into an annular chamber 30, into which also the duct 32 gives out.

The valve body 7 moreover comprises a flange 33 housed in a portion 34 of the cavity 6, having an oversized diameter. The flange 33 is set axially in contact, in a fluid-tight way, with a shoulder 35 of the cavity 6 by a threaded ring nut 36 screwed on an internal thread 37 of the portion 34 of the cavity 6.

As will be seen more clearly in what follows, the armature 17 is associated to a bushing 41 guided axially by a guide element, formed by an axial stem 38, which is made of a single piece with the flange 33 of the valve body 7. The stem 38 extends in cantilever fashion from the flange 33 itself on the side opposite to the hole 9, i.e., towards the cavity 22. The stem 38 has a cylindrical side surface 39, which guides axial sliding of the bushing 41. In particular, the bushing 41 has a cylindrical inner surface 40, coupled to the side surface 39 of the stem 38 in a substantially fluid-tight way, for example with diametral play smaller than 4 μm, or else by means of the interposition of annular sealing elements.

The control chamber 26 also has an outlet passage 42*a* for the fuel, having a restriction or calibrated stretch 53, which in general has a diameter of between 150 and 300 μm. The outlet passage 42*a* is in communication with a discharge duct 42, made inside the flange 33 and the stem 38. The duct 42 comprises a blind axial stretch 43, having a diameter greater than that of the calibrated stretch 53, and at least one substantially radial stretch 44, in communication with the axial stretch 43. Advantageously, there may be envisaged two or more radial stretches 44, set at a constant angular distance, which give out into an annular chamber 46, formed by a groove of the side surface 39 of the stem 38. In FIG. 1, two stretches 44 are provided, inclined with respect to the axis 3, towards the armature 17.

The annular chamber 46 is made in an axial position adjacent to the flange 33 and is opened/closed by an end portion of the bushing 41, which forms an open/close element 47 for said annular chamber 46 and hence also for the radial stretches 44 of the duct 42. The open/close element 47 cooperates with a corresponding detent for closing the servo valve 5. In particular, the open/close element 47 terminates with a stretch having an inner surface shaped like a truncated cone 45 (FIG. 2) flared downwards and designed to stop against a connector shaped like a truncated cone 49 set between the flange 33 and the stem 38.

Advantageously, the connector 49 has two portions of surface shaped like a truncated cone 49*a* and 49*b*, separated by an annular groove 50, which has a cross section substantially shaped like a right triangle. The surface shaped like a truncated cone 45 of the open/close element 47 engages in a fluid-tight way the portion of surface shaped like a truncated cone 49*a*, against which it stops in the closing position. On account of the wear between these surfaces 45 and 49*a*, after a certain time the closing position of the open/close element 47 requires a greater stroke of the bushing 41 towards the connector 49, always defining a maximum diameter of the sealing surface equal to the diameter of the cylindrical stretch of the annular groove 50.

The armature 17 is made of a magnetic material, and is constituted by a distinct piece, i.e., separate from the bushing 41. It has a central portion 56 having a plane bottom surface 57, and a notched annular portion 58, which has a cross section tapered towards the outside. The central portion 56 has an axial hole 59, by means of which the armature 17 engages with a certain degree of radial play along an axial portion of the bushing 41 that acts on the open/close element 47 counteracting the spring 23 to open the servo valve 5.

Figure 2:
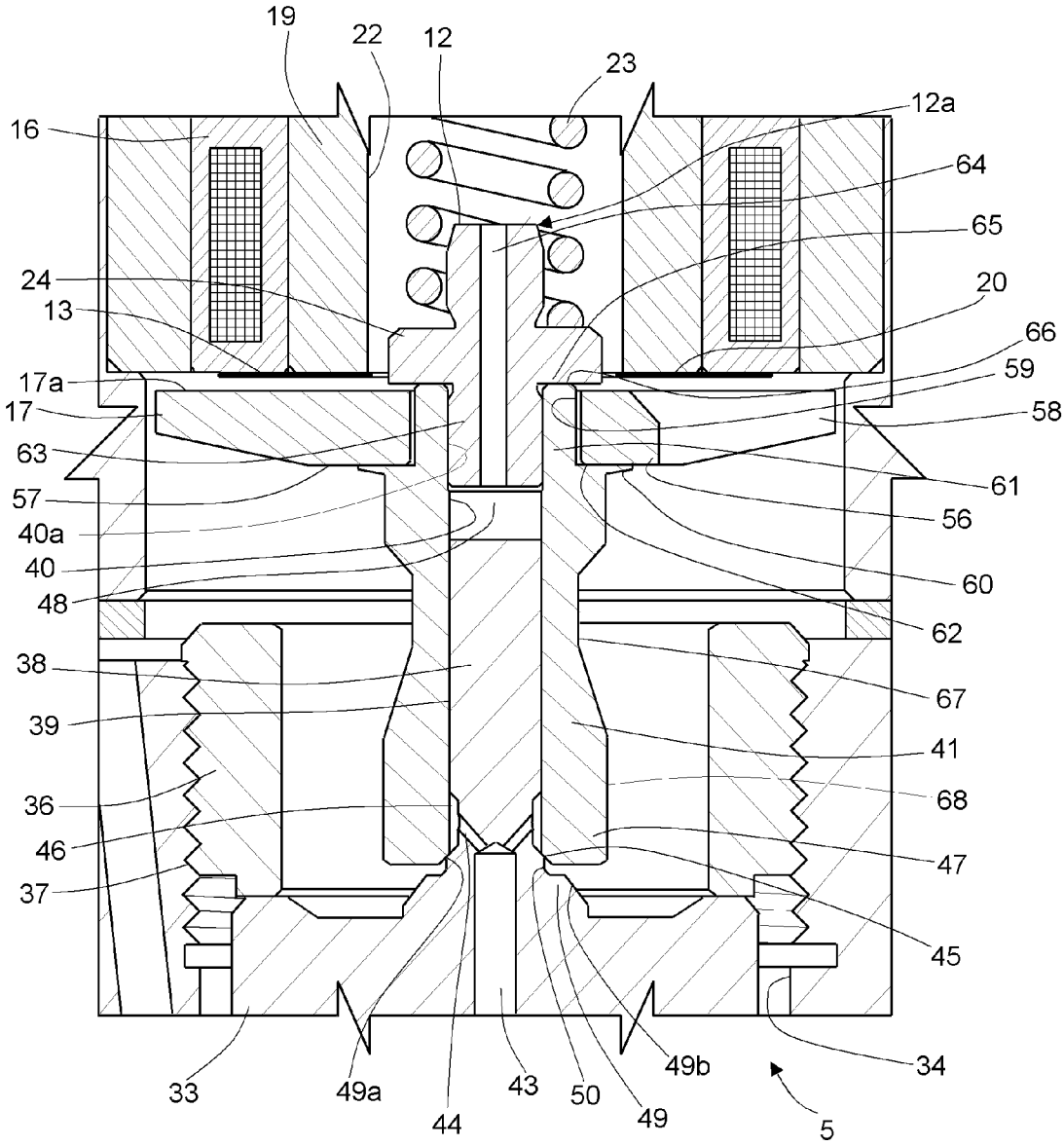
FIG. 2 is a detail of FIG. 1 at an enlarged scale.
Figure 3:
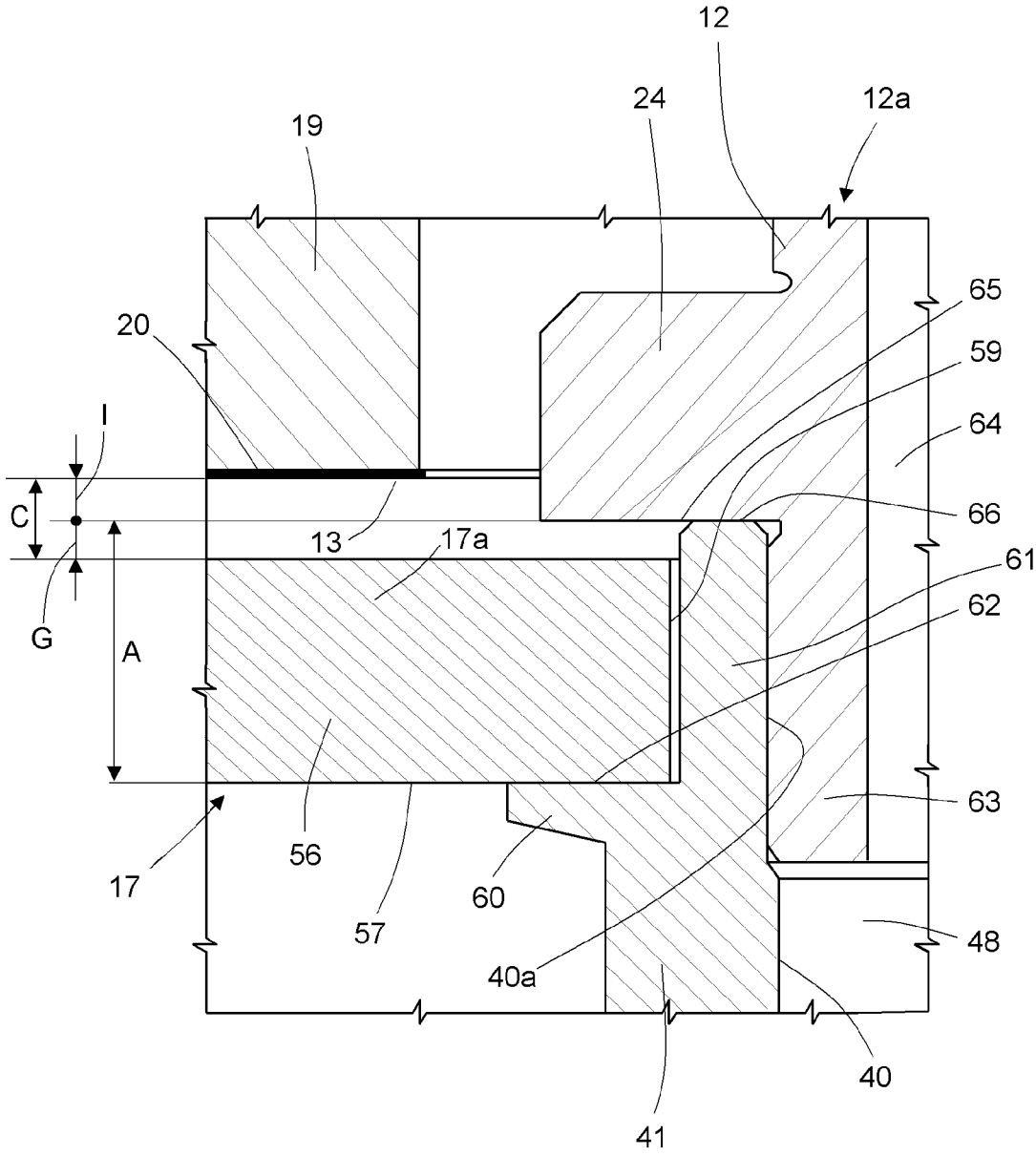
FIG. 3 is a portion of FIG. 2 at a further enlarged scale.

According to the invention the axial portion of the bushing 41 has a projection designed to be engaged by the surface 57 of the armature 17 so as to allow for the latter an axial stroke greater than the stroke of the open/close element 47. In the embodiment of FIGS. 1-3, the axial portion of the bushing 41 is formed by a neck 61, made on a flange 60 of the bushing 41. The neck 61 has a smaller diameter than the bushing 41, and hence also than the flange 60.

The flange 24 has a plane surface 65, designed to engage a surface 17*a* of the armature 17, opposite to the surface 57. The projection of the bushing 41 is constituted by a shoulder 62, formed between the neck 61 and the flange 60, and set in such a way as to create, with the surface 65 of the flange 24, a housing A for the armature 17 such that an axial clearance G (FIG. 3) of a pre-set amount is created in order to enable a relative axial displacement between the armature 17 and the bushing 41.

In addition, the intermediate body 12*a* comprises an axial pin 63 for connection with the bushing 41, which is made of a single piece with the flange 24 and is rigidly fixed to the bushing 41, in a corresponding seat 40*a* (FIG. 2). Advantageously, the seat 40*a* has a diameter slightly greater than the inner surface 40 of the bushing 41. In this way, the surface 40 that is to be ground to provide a fluid-tight contact with the surface 39 of the stem 38, has a reduced length, with evident economic advantages.

The connection pin 63 extends axially from a plane surface 65 of the flange 24 in a direction opposite to the guide pin 12. Between the surface 39 of the stem 38 and the surface 40 of the bushing 41, there is in general a certain leakage of fuel, which gives out into a compartment 48 between the end of the stem 39 and the connection pin 63. In order to enable discharge of the fuel that has leaked into the compartment 48 towards the cavity 22, the intermediate body 12*a* is provided with an axial hole 64.

The distance, or space, between the surface 65 of the flange 24 and the shoulder 62 of the bushing 41 constitutes the housing A of the armature 17 (see also FIG. 3). The plane surface 65 of the flange 24 bears upon an end surface 66 of the neck 61 of the bushing 41 so that the housing A is uniquely defined. Between the shoulder 62 and the open/close element 47, the bushing 41 has an outer surface 68 having an intermediate portion 67 of a reduced diameter in order to reduce the inertia of the bushing 41.

Assuming that the lamina 13 is fixed with respect to the polar surface 20 of the core 19, when the bushing 41, through the intermediate body 12*a*, is held by the spring 23 in the closing position of the servo valve 5, the distance of the plane surface 17*a* from the lamina 13, constitutes the stroke or lift C of the armature 17, which is always greater than the clearance G of said armature 17 in its housing A. The armature 17 is hence found resting against the shoulder 62, in the position indicated in FIGS. 1-3, as will be seen more clearly in what follows. In actual fact, since the lamina 13 is non-magnetic, it could occupy axial positions different from the one hypothesized.

The stroke, or lift I of opening of the open/close element 47 is equal to the difference between the lift C of the armature 17 and the clearance G. Consequently, the surface 65 of the flange 24 projects normally from the lamina 13 downwards by a distance equal to the lift I of the open/close element 47, along which the armature 17 draws the flange 24 upwards. The armature 17 can thus perform, along the neck 61, an over-stroke equal to said clearance G, in which the axial hole 59 of the armature 17 is guided axially by the neck 61.

Operation of the servo valve 5 of FIGS. 1-3 is described in what follows.

When the electromagnet 16 is not energized, via the spring 23 acting on the body 12*a* the open/close element 47 is held resting with its surface shaped like a truncated cone 45 against the portion shaped like a truncated cone 49*a* of the connector 49 so that the servo valve 5 is closed. Assume that, on account of the force of gravity and/or of the previous closing stroke, which will be seen hereinafter, the armature 17 is found detached from the lamina 13 and resting against the shoulder 62. This hypothesis does not, however, affect the effectiveness of operation of the servo valve 5 of the invention, which is irrespective of the axial position of the armature 17 at the instant of energization of the electromagnet 16.

In the annular chamber 46 there has hence been set up a pressure of the fuel, the value of which is equal to the pressure of supply of the injector 1. When the electromagnet 16 is energized to perform a step of opening of the servo valve 5, the core 19 attracts the armature 17, which at the start performs a loadless travel, equal to the clearance G illustrated in FIG. 3, until it comes into contact with the surface 65 of the flange 24, substantially without affecting displacement of the bushing 41. Next, the action of the electromagnet 16 on the armature 17 overcomes the force of the spring 23 and, via the flange 24 and the fixing pin 63, draws the bushing 41 towards the core 19 so that the open/close element 47 opens the servo valve 5. Consequently, in this phase, the armature 17 and the bushing 41 move jointly and follow the stretch I of the entire stroke C allowed for the armature 17.

When energization of the electromagnet 16 ceases, the spring 23, via the body 12*a*, causes the bushing 41 to perform the stroke I towards the position of FIGS. 1-3 for closing the servo valve 5. During a first stretch of this closing stroke I, the flange 24, with the surface 65, draws along with it the armature 17, which hence moves together with the bushing 41 and hence with the open/close element 47. At the end of the stroke I, the open/close element 47 impacts with its conical surface 45 against the portion of surface shaped like a truncated cone 49*a* of the connector 49 of the valve body 7.

On account of the type of stresses, the small area of contact, and the hardness of the open/close element 47 and of the valve body 7, after impact the open/close element 47 rebounds overcoming the action of the spring 23. The rebound is favoured also because the impact occurs in the presence of a considerable amount of vapour of the fuel. Instead, the armature 17 continues its travel towards the valve body 7, recovering the clearance G existing in the housing A between the plane surface 57 of the portion 56 and the shoulder 62 of the flange 60.

At the instant in which the first impact occurs, the open/close element 47 reverses its direction of motion and starts to move towards the armature 17, performing the first rebound. The spring 23 now pushes the bushing 41 again towards the closing position of the solenoid valve. There hence occurs a second impact with corresponding rebound, and so forth so that a train of rebounds of decreasing amplitude is generated, as indicated by the dashed line in FIG. 9.

After a certain time from the first impact there then occurs an impact of the plane surface 57 of the portion 56 against the shoulder 62 of the bushing 41. As a result of this impact, and also on account of the greater momentum of the armature 17, due to its stroke C of greater length than the stroke I, and on account of the greater fluid-dynamic resistance in the direction of the axis 3 of the armature 17, the rebounds of the bushing 41 are reduced sensibly or even vanish.

Figure 9:
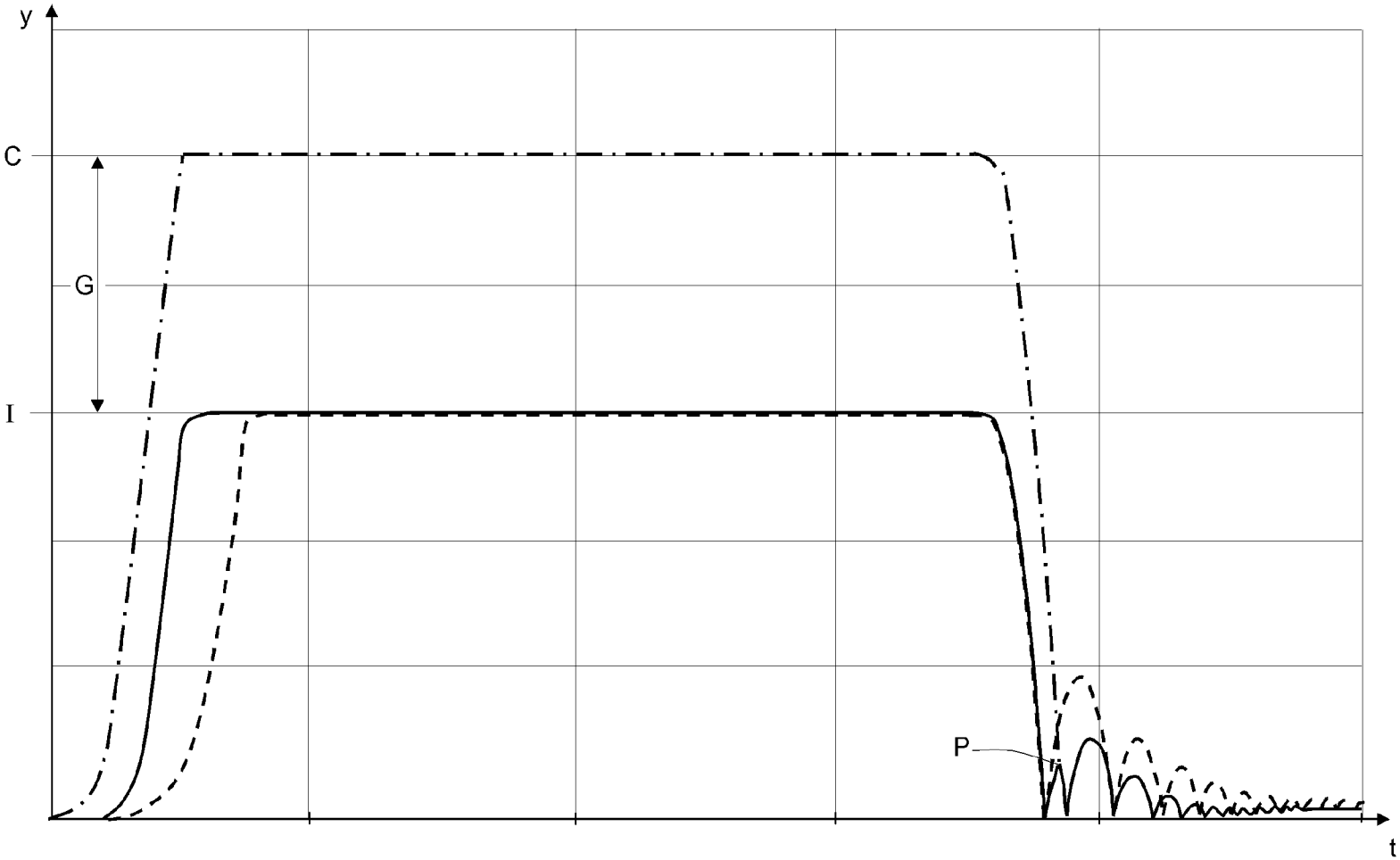
FIGS. 9-11 are comparative diagrams of operation of the injectors of the invention.

Advantageously, the weights of the armature 17 and of the bushing 41, the stroke C of the armature 17, and the stroke I of the open/close element 47 are sized so that the impact of the armature 17 against the bushing 41, represented by point P in FIG. 9, will occur during the first rebound immediately after de-energization of the electromagnet 16, said first rebound being the one of greatest amplitude. In this case, the impact of the armature 17 against the shoulder 62 blocks the first rebound so that also the further rebounds prove of smaller amplitude.

In order to obtain the impact P during the first rebound, if the weight of the armature 17 is substantially equal to that of the bushing 41, the stroke I of the open/close element 47 can be comprised between 12 and 30 μm and the clearance G can be comprised between 6 and 30 μm so that the stroke C will be comprised between 18 and 60 μm. Consequently, the ratio C/I between the lift C of the armature 17 and the stroke I of the open/close element 47 can be comprised between 1.5 and 2, whilst the ratio I/G between the lift I and the clearance G can be comprised between 0.4 and 5. For reasons of graphical clarity, in the drawings the strokes I, G and C are not in scale with the ranges of the values defined.

Figure 10:
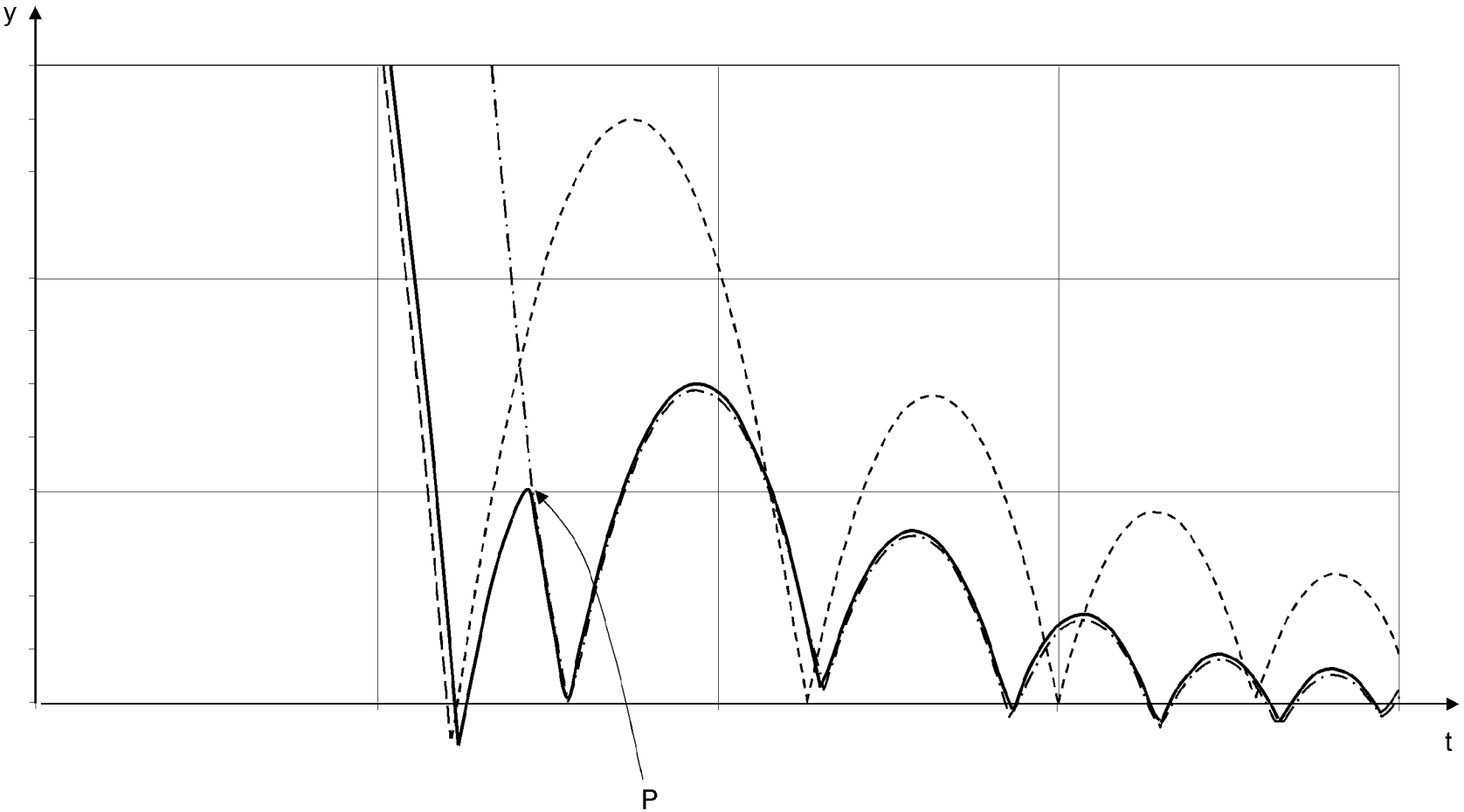

FIGS. 9 and 10 show the diagrams of operation of the solenoid valve 5 of FIGS. 1-3, in comparison with operation of a solenoid valve according to the known art. In FIG. 9, indicated with a solid line, as a function of time t, is the displacement of the open/close element 47 separate from the armature 17, with respect to the valve body 7. Both the armature 17 and the bushing 41 have each been made with a weight of around 2 g. The value "I", indicated on the axis Y of the ordinates, represents the maximum stroke I allowed for the open/close element 47. The travel of an open/close element according to the known art is indicated, instead, with a dashed line: in such element, the armature is fixed with respect to, or is made of a single piece with, the bushing, and the total weight is in the region of 4 g. The two diagrams are obtained by displaying the effective displacement of the open/close element 47. From the two diagrams it emerges that, mainly on account of the fact that the armature 17 is separate from the bushing 41, the motion of opening of the open/close element 47 according to the invention occurs with a prompter response as compared to the motion of opening of the open/close element according to the known art. At the end of the closing motion, the open/close element according to the known art performs a series of rebounds of decreasing amplitude, of which the amplitude of the first rebound is decidedly considerable. Instead, for the open/close element 47 according to the invention, on account of the impact P, the amplitude of the first rebound proves reduced to approximately one third that of the known art. Also the subsequent rebounds are damped more rapidly.

On the axis Y of the ordinates in FIG. 9 the value "C" given is equal to the maximum stroke allowed for the armature 17. In FIG. 9, moreover indicated with a dashed-and-dotted line is the displacement of the armature 17, which performs, in addition to the stroke I of the open/close element 47, an over-stroke equal to the clearance G between the armature 17 and the flange 24. Towards the end of the closing stroke C of the armature 17, at the instant represented by point P, the armature 17 impacts against the shoulder 62 of the bushing 41, whilst this performs the first rebound so that the bushing 41 is pushed by the armature 17 towards the closing position. From the instant of this impact onwards, the armature 17 remains in contact with the shoulder 62, oscillating imperceptibly together with the bushing 41.

The diagrams of FIG. 9 are indicated in FIG. 10 at a very enlarged scale, substantially starting from the stretch in which the first rebound occurs. It consequently emerges clearly that, after impact of the armature 17 against the shoulder 62, the bushing 41 oscillates practically together with said armature 17, substantially without re-opening the annular chamber 46, thus preventing the control chamber 26 from emptying out suddenly. In this way, any alteration of the gradient of variation envisaged for the pressure in the control chamber 26, and hence any delay of closing of the needle of the nebulizer, is reduced or eliminated.

In general, given the same stroke I of the open/close element 47, the greater the clearance G between the armature 17 and the flange 24, the greater the delay of its travel with respect to that of the bushing 41 so that the dashed-and-dotted line of FIG. 10 displaces towards the right. The degree of the first rebound of the open/close element 47 proves greater until the point P of the impact occurs during the re-opening travel of the open/close element 47. However, since the armature 17 has acquired a greater speed, due to the greater momentum, the impact annuls the kinetic energy of the bushing 41 in the rebound phase, which can now return at a lower speed towards the closing position, substantially without any further rebounds, or with just a few rebounds of the open/close element 47 that have a negligible amplitude.

Instead, if the clearance G between the armature 17 and the flange 24 is smaller, at the first rebound of the open/close element 47, the shoulder 62 immediately encounters the armature 17. The latter can hence be drawn along, reversing its motion and exerting a reaction against the spring 23. In this case, the train of rebounds subsequent to the first one could be temporally longer. However, also these subsequent rebounds prove to be very attenuated, i.e., of a much smaller degree, so that they are unable to bring about a decrease of pressure in the control chamber 26. Consequently, there is no anomalous reconstitution of the pressure of the fuel in the control chamber 26. Finally, the armature 17 remains in contact with the shoulder 62, also as a result of the force of gravity.

Figure 11:
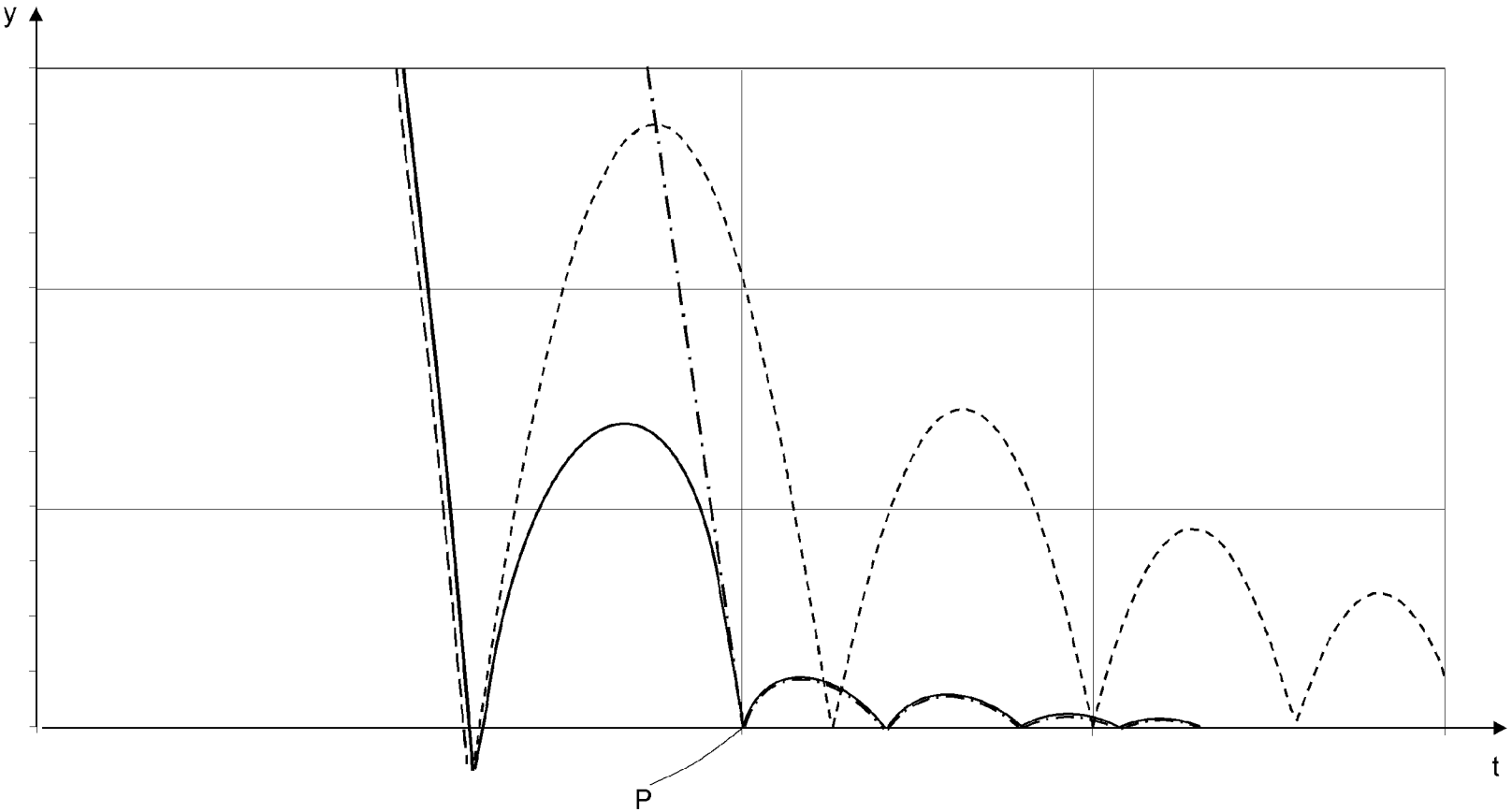

Preferably, the strokes of the armature 17 and of the open/close element 47 can be chosen so that the impact of the armature 17 with the shoulder 62 occurs exactly at the instant in which the open/close element 47 recloses the solenoid valve 5 after the first rebound, i.e., at the instant in which the point P coincides with the end of the first rebound, as indicated in the diagram of FIG. 11. For said purpose, in the case of the injector of FIGS. 1-3 described above, assuming that the open/close element 47 presents a sealing diameter of approximately 2.5 mm, that the pre-loading of the spring 23 is approximately 50 N and the stiffness thereof is approximately 35 N/mm, and that the total weight of the armature 17 and of the bushing 41 is approximately 2 g, the lift I of the open/close element 47 can be comprised between 18 and 22 μm, the clearance G can be approximately 10 μm so that the stroke C will be comprised between 28 and 32 μm. Consequently, the ratio C/I between the lift C of the armature 17 and the lift I of the open/close element 47 can be comprised between 1.45 and 1.55, whilst the ratio I/G between the lift I and the clearance G can be comprised between 1.8 and 2.2.

The main advantage of the invention is that the subsequent rebounds of the open/close element 47 on the surface of arrest **49*a* of the connector 49 are practically altogether avoided, even though the armature 17 performs a train of further rebounds of smaller amplitude, against the shoulder 62 that is already stationary. These rebounds, in addition to not having any effect on the evolution of the pressure in the control chamber 26, i.e., on closing of the servo valve 5 and on the precision of the instant of said closing, do not have a consistency such as to wear out the surfaces of tightness and of mutual sliding: consequently, the servo valve 5 will present a high stability of operation over time, which does not decrease even in case of wear of the open/close element 47 and of the surface 49***a*. In addition, since the impact of the surface 57 of the armature 17 occurs with the shoulder 62 temporarily stationary, in the impact the relative speed between the two surfaces is reduced. An additional advantage of this solution lies in the fact that the mechanical effects of the impact of the surface 57 on the shoulder 62 are reduced so that the service life of the injector increases.

In the embodiments of FIGS. 4-8, the parts similar to those of the embodiment of FIGS. 1-3 are designated by the same reference numbers, and will not be described any further. The diagrams of operation of the servo valve of FIGS. 9-11 have been obtained for the embodiment illustrated in FIGS. 1-3. However, they are well suited to describing, qualitatively, the working principle of the other embodiments.

Figure 4:
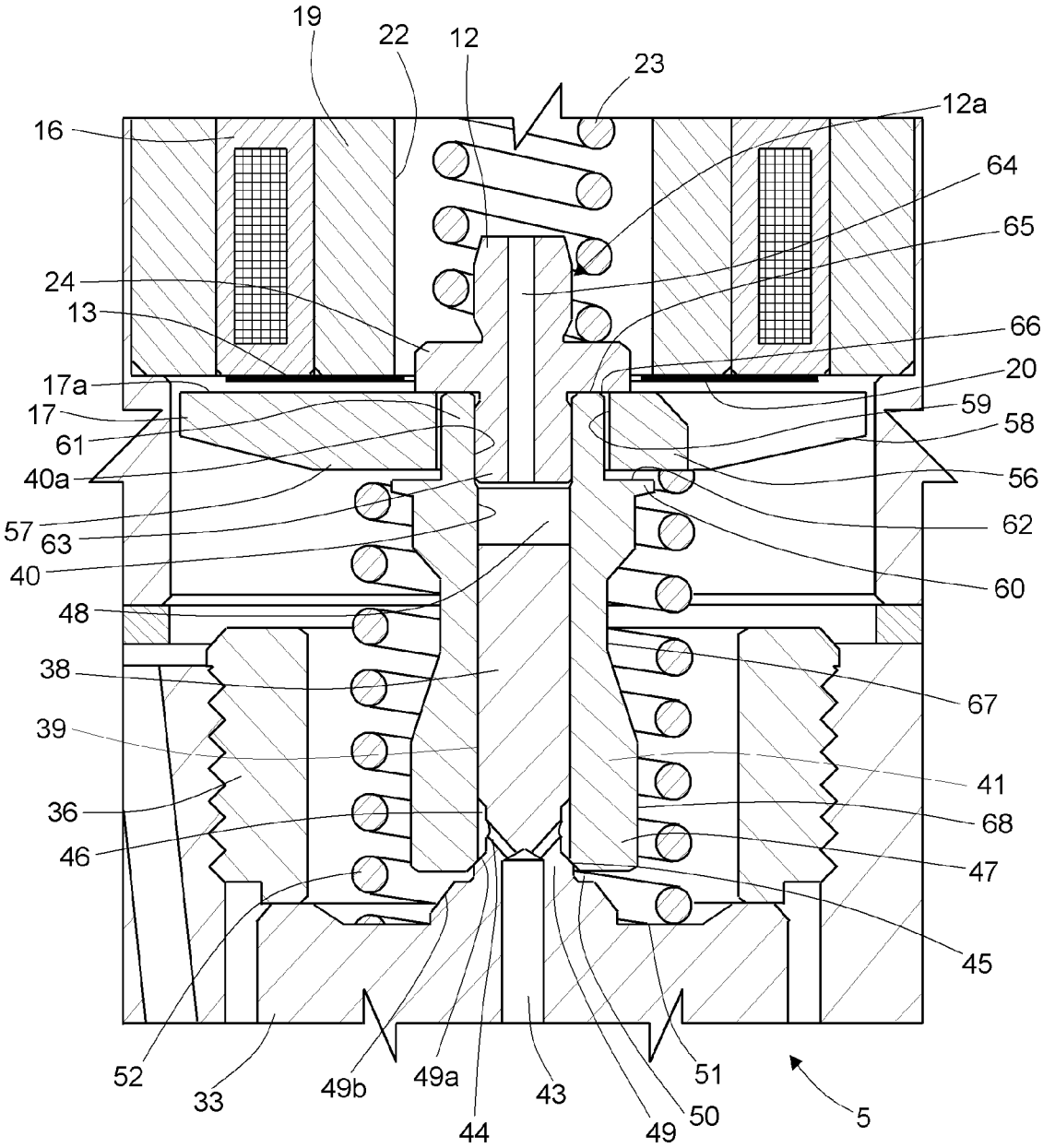
FIG. 4 is a vertical section of the detail of FIG. 2 according to another embodiment of the invention.
Figure 5:
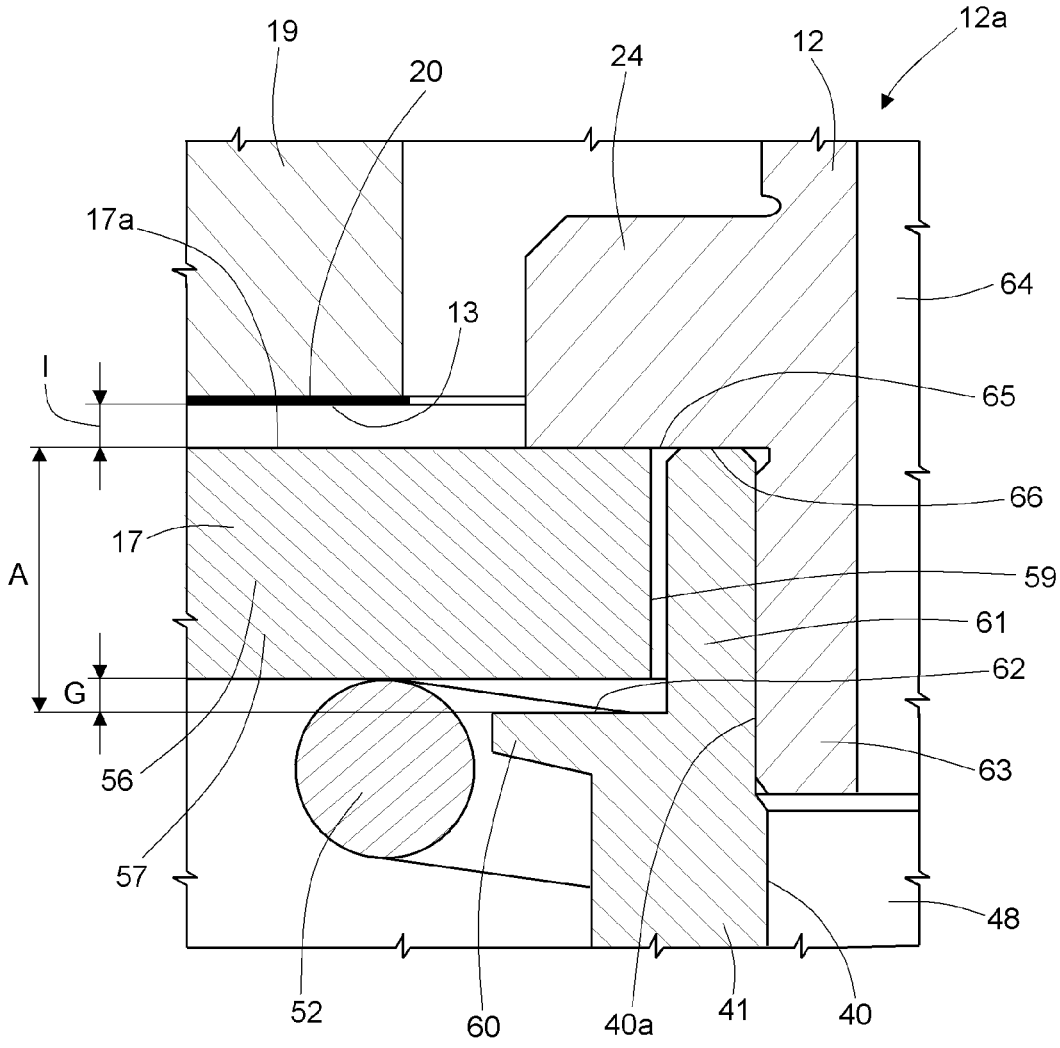
FIG. 5 is a portion of FIG. 4 at a further enlarged scale.

According to the embodiment of FIGS. 4 and 5, in order to reduce the times of opening of the open/close element 47, especially when the injector 1 is supplied at low pressure, a helical compression spring 52 is inserted between the surface 57 of the portion 56 of the armature 17 and a depression 51 of the top surface of the flange 33 of the valve body 7. The spring 52 is pre-loaded so as to exert a much lower force than the one exerted by the spring 23, but sufficient to hold the armature 17, with the surface 17*a* in contact with the surface 65 of the flange 24, as indicated in FIGS. 4 and 5.

In order to obtain an operation in which the armature 17 impacts against the shoulder 62 during the first rebound, as illustrated in FIGS. 9 and 10, with the stroke of the open/close element 47 comprised between 12 and 30 μm, in this embodiment the clearance G of the armature 17 can be chosen between 10 and 30 μm so that the stroke C=I+G is comprised between 22 and 60 μm, the ratio C/I is comprised between 1.83 and 2 and the ratio I/G is comprised between 1 and 1.2. In this embodiment, upon energization of the electromagnet 16, the armature 17 on the one hand follows a shorter travel towards the core 19, and on the other draws immediately the bushing 41 along with it. There is hence obtained a faster opening of the open/close element 47, i.e., a faster response of the open/close element 47 to the corresponding command.

In order to obtain an operation in which the armature 17 impacts against the shoulder 62 at the end of the first rebound, as illustrated in FIG. 11, the stroke of the open/close element 47 can be comprised between 18 and 22 μm, and the clearance G of the armature 17 may be equal to approximately 10 μm so that, also in this case, the stroke C=I+G will be comprised between 28 and 32 μm, the ratio C/I is comprised between 1.45 and 1.55 and the ratio I/G is comprised between 1.8 and 2.2. For reasons of graphical clarity, the strokes I, G and C in FIGS. 1-7 are not in scale with the ranges of the values defined above.

Figure 6:
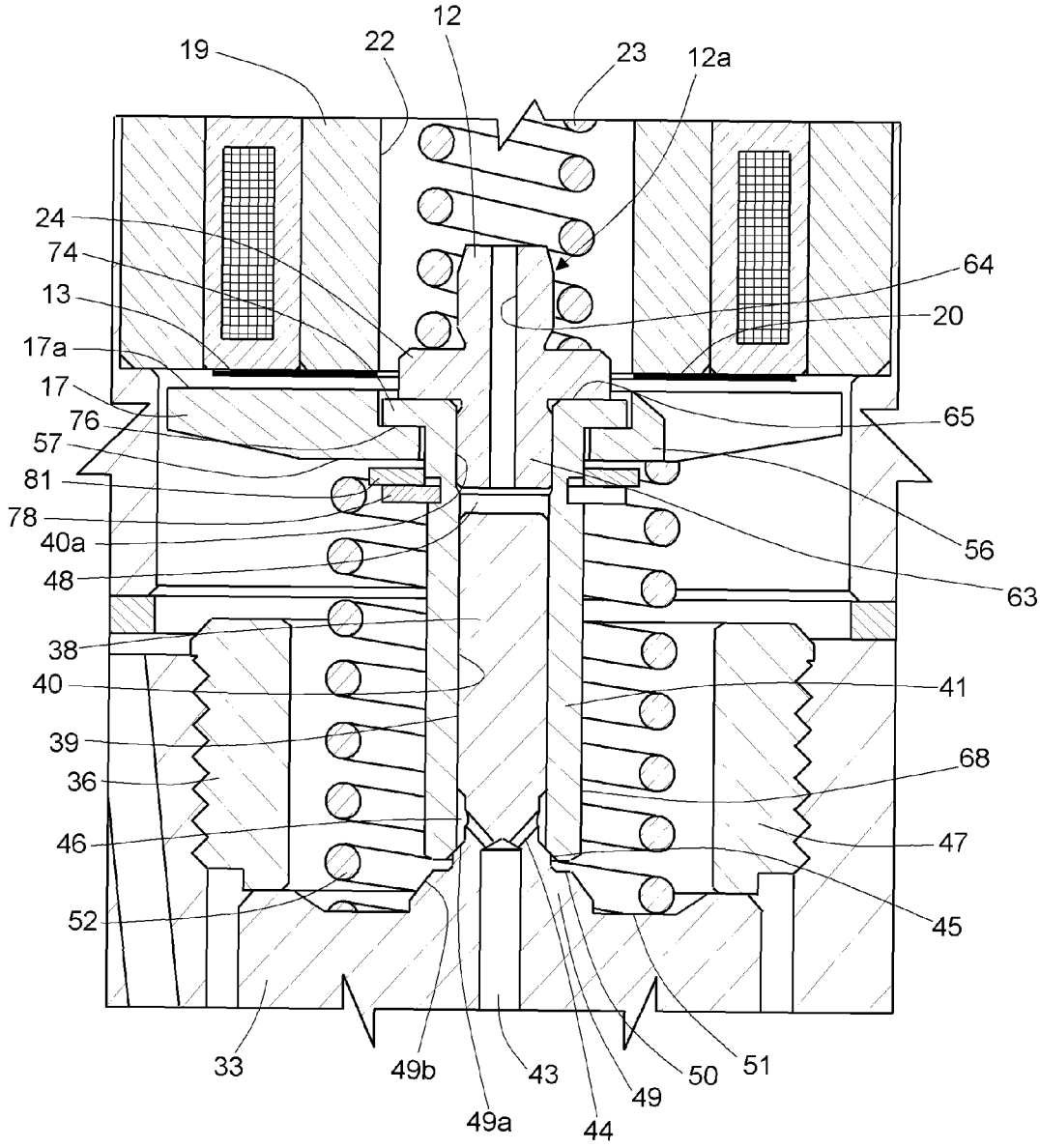
FIG. 6 is a vertical section of the detail of FIG. 2 according to a further embodiment of the invention.
Figure 7:
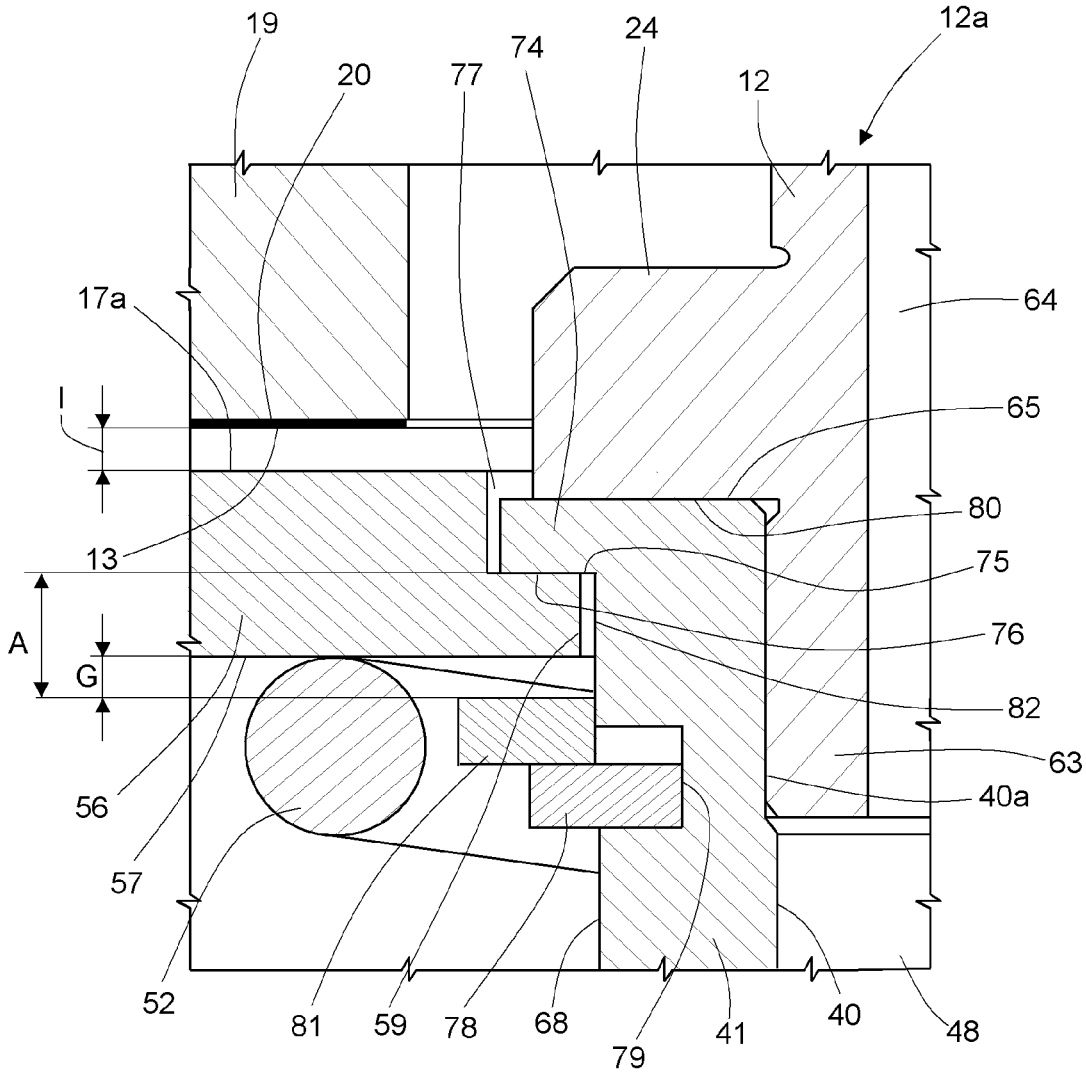
FIG. 7 is a portion of FIG. 6 at a further enlarged scale.

In the embodiment of FIGS. 6 and 7, the means of engagement between the bushing 41 and the armature 17 are represented by a rim or annular flange 74 made of a single piece with the bushing 41. In particular, the rim 74 has a plane surface 75 designed to engage a shoulder 76 formed by an annular depression 77 of the plane surface 17*a* of the armature 17.

The central portion 56 of the armature 17 is here able to slide on an axial portion 82 of the bushing 41, adjacent to the rim 74. In addition, the rim 74 is adjacent to an end surface 80 of the bushing 41, which is in contact with the surface 65 of the flange 24. Obviously, the annular depression 77 has a greater depth than the thickness of the rim 74 in order to enable the entire stroke of the armature 17 towards the core 19 of the electromagnet 16. The shoulder 76 of the armature 17 is normally kept in contact with the plane surface 75 of the rim 74 by the compression spring 52, in a way similar to that has been seen for the embodiment of FIGS. 4 and 5.

Figure 8:
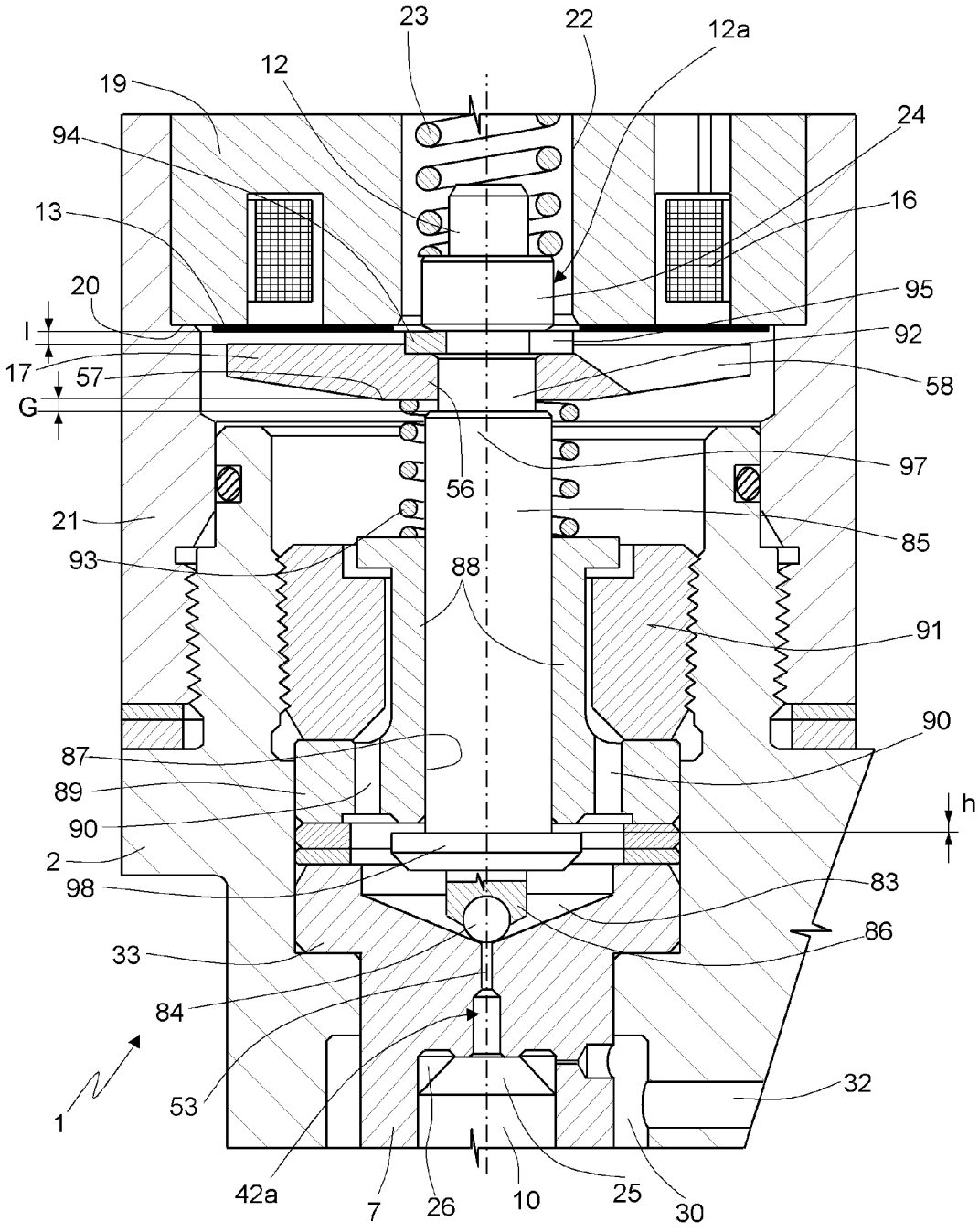
FIG. 8 is a partial vertical section of another type of injector with high stability of operation, according to the invention.

In the embodiment of FIG. 8, the flange 33 of the valve body 7 is here provided with a conical depression 83 in which the calibrated portion 53 of the outlet passage 42*a* for the control chamber 26 gives out. The open/close element of this servo valve is constituted by a ball 84, which is controlled by a stem 85, through a guide plate 86. The stem 85 comprises a portion 87, which is able to slide in a sleeve 88, in turn made of a single piece with a flange 89 provided with axial holes 90, which is kept fixed against the flange 33 of the valve body 7 by a threaded ring nut 91. The holes 90 have the purpose of enabling discharge of the fuel from the control chamber 26 towards the cavity 22.

The stem 85 moreover comprises a portion 92 of a reduced diameter on which the armature 17 is able to slide, said armature 17 normally resting on account of the action of a spring 93 against a C-shaped ring 94 inserted in a groove 95 of the stem 85. The groove 95 separates the portion 92 of the stem 85 from the end portion 12*a* comprising the flange 24 on which the spring 23 acts, and the pin 12 for guiding the end of the spring 23 itself. The spring 23 hence acts on the open/close element 84 through the engagement means comprising the flange 24 and the stem 85.

The projection means, designed to be engaged by the surface 57 of the central portion 56 of the armature 17 are constituted by an annular shoulder 97 set between the two portions 87 and 92 of the stem 85. The shoulder 97 is set in such a way as to define, with the bottom surface of the C-shaped ring 94, the housing A of the armature 17. In addition, the shoulder 97 forms, with the surface 57 of the portion 56 of the armature 17 the clearance G of the armature 17.

Instead, the top surface 17*a* of the armature 17 forms, with the lamina 13 on the polar surface 20 of the electromagnet 16, the stroke I of the stem 85, and hence also of the open/close element 84, whilst the stroke C of the armature 17 is formed by the sum of the clearance G and of the stroke I, in a way similar to that has been seen for the embodiment of FIGS. 4 and 5. Finally, the stem has a bottom flange 98 designed to engage the plate 86, after a stroke h greater than the stroke I of the open/close element 84. The flange 98 is designed to be blocked by the flange 89 of the sleeve 88, in the case where the C-shaped ring 94 is removed from the groove 95.

Operation of the servo valve 5 of FIG. 8 is similar to that of the embodiment of FIGS. 4 and 5 and will not be repeated here. In the closing travel of the open/close element or ball 84, this is subject to the rebounds together with the plate 86 and the stem 85. The armature 17 impacts then against the shoulder 97 of the stem 85, damping or eliminating the rebounds thereof. The values of the strokes I and C and of the clearance G can be chosen so as to have a damping of the rebounds according to the diagram of FIG. 11.

In the particular case of the injector of FIG. 8, which has the open/close element 84 that is spherical with a diameter of approximately 1.33 mm, and a sealing diameter of 0.65 mm, with the weight of the armature of approximately 2 g, the weight of the stem 85 of approximately 3 g, the pre-loading of the spring 23 of 80 N and the stiffness thereof of 50 N/mm, it is possible to obtain an operation according to the diagram of FIG. 11 with a stroke I of the open/close element 84 comprised between 30 and 45 μm. Assuming also here a clearance G equal to approximately 10 μm, a stroke C is obtained comprised between 40 and 55 μm so that the ratio C/I can be comprised between 1.2 and 1.3, whilst the ratio I/G can be comprised between 3 and 4.5. Also in the case of FIG. 8, for reasons of graphical clarity, the strokes I, G and C are not in scale with the ranges of the values defined.

From what has been seen above, the advantages of the injector 1 according to the invention as compared to the injectors of the known art are evident. In the first place, the armature 17, which is separate from the open/close element, i.e., from the guide bushing 41 (FIGS. 1-7) or from the guide stem 85 (FIG. 8), and can be displaced irrespective of the open/close element 47, respectively 84, enables reduction or elimination of the rebounds of the open/close element at the end of the closing travel. In this way, the needs are avoided to inject a volume of fuel significantly greater than the one envisaged and to alter the air-fuel proportion, and consequently there is no longer the problem of reducing the environmental pollution by the engine exhaust gases.

In particular, according to the invention, in the case where the strokes of the armature 17 and of the open/close element are sized in such a way that the impact of the armature 17 against the bushing 41 or the stem 85 occurs at the end of the first rebound, any wear of the corresponding surfaces is reduced, and the train of rebounds subsequent to the first rebound is eliminated so that both the life of the injector and the stability over time of operation of the injector increase.

It is evident that other modifications and improvements may be made to the injector 1 without departing from the scope of the invention. For example, in the embodiments of FIGS. 1-5, the flange 60 of the bushing 41 can be eliminated. In order to adjust the clearance G between the armature 17 in the housing A, it is possible to insert at least one disk-shaped spacer of appropriate modular thickness, for example in classes of 5 μm, coaxial to the armature 17 itself.

In the embodiment of FIGS. 6 and 7, the retention ring 78 can also be welded on the bushing 41, instead of being mounted in a removable way. In addition, in this embodiment it is possible to eliminate the spring 52 so that the armature 17 behaves as in the case of the embodiment of FIGS. 1-3. In turn, the lamina 13 can have an internal diameter smaller than the external diameter of the flange 24, and in the limit equal to the internal diameter of the armature 17. In this case, the lamina 13 remains constrained in the housing A and consequently cannot undergo any radial displacements. It is evident that in this case, the axial length of the housing A must be increased by the thickness of the lamina 13 itself. In addition, the connector 49 between the stem 38 and the flange 33 of the valve body 7 of FIGS. 1-7 can be without the groove 50, and the surface shaped like a truncated cone 45 of the open/close element 47 can be replaced by a sharp edge. Finally, in the embodiment of FIG. 8, the shoulder 97 can be replaced by a ring similar to the ring 81 of the embodiment of FIGS. 6 and 7.

The invention claimed is:

1. A fuel injector with high operation stability for an internal combustion engine, comprising:

a metering servo valve including a control chamber having a fuel inlet and a fuel outlet configured to be supplied with fuel to control a rod configured to control fuel injection in the internal combustion engine;

an open/close element configured to move for an axial stroke (C) to cooperate with a corresponding valve seat under the action of urging means to close the fuel outlet of the control chamber; and an electric actuator operable to act on the open/close element against the action of the urging means via an armature to open the fuel outlet of the control chamber, the armature being separate from the open/close element and configured to move for an axial stroke (I) greater than the axial stroke (C) of the open/close element;

wherein respective weights of the armature and the open/close element, and respective lengths of the axial strokes (C, I) of the armature and the open/close element are sized so that when the fuel outlet of the control chamber closes, the armature impacts against the open/close element during a first rebound thereof away from the valve seat after de-energization of the electric actuator to oppose bouncing of the open/close element.

2. The fuel injector according to claim 1, wherein the respective lengths of the strokes (C, I) of the armature and of the open/close element are sized so that the armature impacts against the open/close element when the open/close element recloses the metering servo valve after the first rebound of the open/close element away from the valve seat.

3. The fuel injector according to claim 1, wherein the armature is guided axially by a guide element, the urging means are configured to act on the open/close element through engagement means; and the armature comprises a plane surface designed to engage axially projection means carried by the guide element to define an axial housing for the armature.

4. The fuel injector according to claim 3, wherein the guide element comprises a bushing made of a single piece with the open/close element, and the urging means are configured to act on the bushing through an intermediate body for bringing the open/close element into a closing position.

5. The fuel injector according to claim 4, wherein the metering servo valve has a valve body comprising an axial stem configured to guide the bushing, the fuel outlet of the control chamber comprises a discharge duct carried by the axial stem comprising at least one substantially radial stretch that gives out onto a side surface of the axial stem; the bushing is slidable between a position of closing and a position of opening of the stretch.

6. The fuel injector according to claim 5, wherein the projection means are carried by the bushing in a position such that when the electric actuator is operated, the armature brings the open/close element into the position of opening.

7. The fuel injector according to claim 6, wherein the armature comprises a central portion having the plane surface designed to engage axially with the projection means, and an end surface of the bushing is in contact with a plane surface of the intermediate element body.

8. The fuel injector according to claim 6, wherein the engagement means are formed by a flange of the intermediate body, and the bushing is rigidly connected to intermediate body.

9. The fuel injector according to claim 8, wherein the projection means comprise an annular shoulder formed by a neck of the bushing, the central portion of the armature is slidable on the neck, and the flange is provided with a plane surface designed to define the axial stroke of the armature.

10. The fuel injector according to claim 9, wherein another surface of the armature opposite to the plane surface is designed to be engaged by the plane surface of the flange, and an end surface of the neck is in contact with the plane surface of the flange.

11. The fuel injector according to claim 7, wherein the engagement means are formed by an annular rim of the bushing, the intermediate body is provided with a flange having a pin connected to the bushing, and the end surface is formed by an end surface of the bushing.

12. The fuel injector according to claim 11, wherein the annular rim is adjacent to the end surface of the bushing, the other surface of the armature comprises an annular depression having a depth greater than the thickness of the annular rim.

13. The fuel injector according to claim 12, wherein the bushing is provided with an annular groove adjacent to an axial portion of the bushing designed to house a ring included in the projection means for engaging the armature.

14. The fuel injector according to claim 13, wherein the ring has a modular thickness in order to enable an adjustment of the axial stroke of the open/close element.

15. The fuel injector according to claim 14, wherein the ring is designed to support at least one spacer with a modular thickness in order to enable an adjustment of the axial stroke of the open/close element.

16. The fuel injector according to claim 7, wherein the intermediate body is provided with a hole designed to set in communication a compartment between the bushing and the intermediate body with a cavity for discharge of the fuel from the control chamber.

17. The fuel injector according to claim 4, wherein the weight of the armature is substantially equal to the weight of the bushing.

18. The fuel injector according to claim 1, wherein the open/close element is formed by a ball, the guide element is formed by a stem designed to control the ball, and the urging means are configured to act on the stem through an intermediate body.

19. The fuel injector according to claim 1, wherein the axial stroke (C) of the armature is between about 18 and about 60 μm, a ratio (C/I) of the axial strokes (C, I) of the open/close element and the armature is between about 1.5 and about 2, and a ratio (I/G) of the axial stroke (I) of the armature and the axial clearance (G) between the open/close element and the armature is between about 1 and about 2.

20. The fuel injector according to claim 19, wherein the ratio (C/I) is between about 1.45 and about 1.55, and the ratio (I/G) is between about 1.8 and about 2.4.

21. A fuel injector with high operation stability for an internal combustion engine, comprising:

a metering servo valve including a control chamber having a fuel inlet and a fuel outlet configured to be supplied with fuel to control a rod configured to control fuel injection in the internal combustion engine;

an open/close element configured to move for an axial stroke (C) to cooperate with a corresponding valve seat under the action of a biasing element to close the fuel outlet of the control chamber; and an electric actuator operable to act on the open/close element against the action of the urging means via an armature to open the fuel outlet of the control chamber, the armature being separate from the open/close element and configured to move for an axial stroke (I) greater than the axial stroke (C) of the open/close element;

wherein respective weights of the armature and the open/close element, and respective lengths of the axial strokes (C, I) of the armature and the open/close element are sized so that when the fuel outlet of the control chamber closes, the armature impacts against the open/close element during a first rebound thereof away from the valve seat after de-energization of the electric actuator to oppose bouncing of the open/close element.

* * * * *